United States Patent [19]

Morrissey

[11] Patent Number: 5,052,256

[45] Date of Patent: Oct. 1, 1991

[54] APPARATUS FOR CUTTING SHINGLES

[76] Inventor: N. Richard Morrissey, 3405 Woodmar Ct., West Lafayette, Ind. 47906

[21] Appl. No.: 337,316

[22] Filed: Apr. 13, 1989

[51] Int. Cl.[5] ..... B26D 7/01

[52] U.S. Cl. ..... 83/468; 83/599; 83/605; 83/607; 83/920

[58] Field of Search ..... 83/467 R, 581, 468, 83/599, 598, 597, 605, 920, 467.1, 589; 72/332

[56] References Cited

U.S. PATENT DOCUMENTS

| | | | |
|---|---|---|---|
| 429,809 | 6/1890 | Heinzelman et al. | 72/332 |
| 1,092,381 | 4/1914 | Neely | 83/589 |
| 1,509,135 | 9/1924 | Fuente | 83/598 |
| 1,665,600 | 4/1928 | Mortimer | 83/920 |
| 3,134,285 | 5/1964 | Greene | 83/920 |
| 3,455,197 | 7/1969 | Richardson | 83/598 |
| 3,779,119 | 12/1973 | Broides | 83/468 |
| 4,510,834 | 4/1985 | Greene et al. | 83/581 |
| 4,688,457 | 8/1987 | Neilsen et al. | 83/468 |
| 4,745,834 | 5/1988 | Neumann | 83/468 |
| 4,951,540 | 8/1990 | Cross et al. | 83/467.1 |

*Primary Examiner*—Frank T. Yost
*Assistant Examiner*—Hwei-Siu Payer
*Attorney, Agent, or Firm*—Woodard, Emhardt, Naughton, Moriarty & McNett

[57] ABSTRACT

A shingle cutting apparatus includes a base, a lever arm pivotally mounted to the base, and a pair of diverging cutting blades mounted to the lever arm. The base includes a shingle-receiving surface upon which a shingle may be positioned for cutting. A pair of grooves are defined in the shingle-receiving surface corresponding to the positions of the cutting blades. In operation, the lever arm is moved downwardly against a shingle, and the cutting blades extend through the shingle and into the corresponding grooves in the base. A ruled back stop and a removable end stop are included to facilitate desired cutting of a shingle. The apparatus may be modified to replace the pair of diverging blades with a single, perpendicular blade for cutting straight-line partial shingles. The apparatus is particularly useful for cutting partial shingles in a variety of widths, and most particularly for cutting the conventional six-sided ridge cap shingle.

4 Claims, 2 Drawing Sheets

APPARATUS FOR CUTTING SHINGLES

BACKGROUND OF THE INVENTION

1. Field of the Invention

The present invention relates to the field of devices for cutting shingles, and particularly to a device for cutting shingles for a ridge cap.

2. Description of the Prior Art

A variety of devices are provided in the prior art for cutting shingles and other sheet-like materials. Paper cutters, for example, are well known in the art, and typically include a base for supporting the paper, and an arm which pivots downwardly and cuts the paper with a scissor-like action. In U.S. Pat. No. D228,825, issued to Pottern on Oct. 23, 1973, there is disclosed a conventional paper cutter of this design. A similar device, but provided for cutting siding, is disclosed in U.S. Pat. No. 3,134,285 issued to Greene on May 26, 1964. A sheet material cutter is described in U.S. Pat. No. 3,261,250, issued to Parks, et al. on July 19, 1966, which includes a base that carries a U-shaped cutting blade and a platen that is pivoted down against the blade to effect the cutting action.

A variety of shingle cutting machines have also been described in the prior art. In U.S. Pat. No. 1,623,983, issued to Speer on Apr. 12, 1927, there is described a machine for cutting shingles into strips having complex shapes. The Speer machine utilizes multiple cutting blades mounted on a rotary drum. A cutting device which also uses knives mounted on a rotating support is disclosed in U.S. Pat. No. 1,682,921, issued to McFarland on Sept. 4, 1928. A shingle trimming machine using a reciprocating action is described in U.S. Pat. No. 387,389, issued to Batt on Aug. 7, 1888.

SUMMARY OF THE INVENTION

Briefly describing one aspect of the present invention, there is provided an apparatus for cutting shingles which includes a base having a flat, shingle-receiving surface, a lever arm having a first end pivotally mounted to the base and a second end defining a handle portion, a blade support attached to the lever arm, and a pair of blades secured to the blade support having cutting edges positioned for cutting a shingle positioned on the base, the base including a pair of grooves positioned to receive the cutting edges of the blades which the lever arm is pivoted downwardly thereagainst, the pair of blades being positioned in diverging relationship to one another in the direction away from the pivoted end of the lever arm.

It is an object of the present invention to provide a shingle cutting apparatus which will accurately and repeatedly cut shingles into a ridge cap shape.

A further object of the present invention is to provide a shingle cutting apparatus which avoids the need for individual hand cutting of shingles into partial shapes.

It is a further object of the present invention to provide a shingle cutting apparatus which is durable in construction, and is portable and readily used.

Further objects and advantages of the present invention will become apparent from the description of the preferred embodiment as follows.

DESCRIPTION OF THE PREFERRED EMBODIMENT

Figure 1:
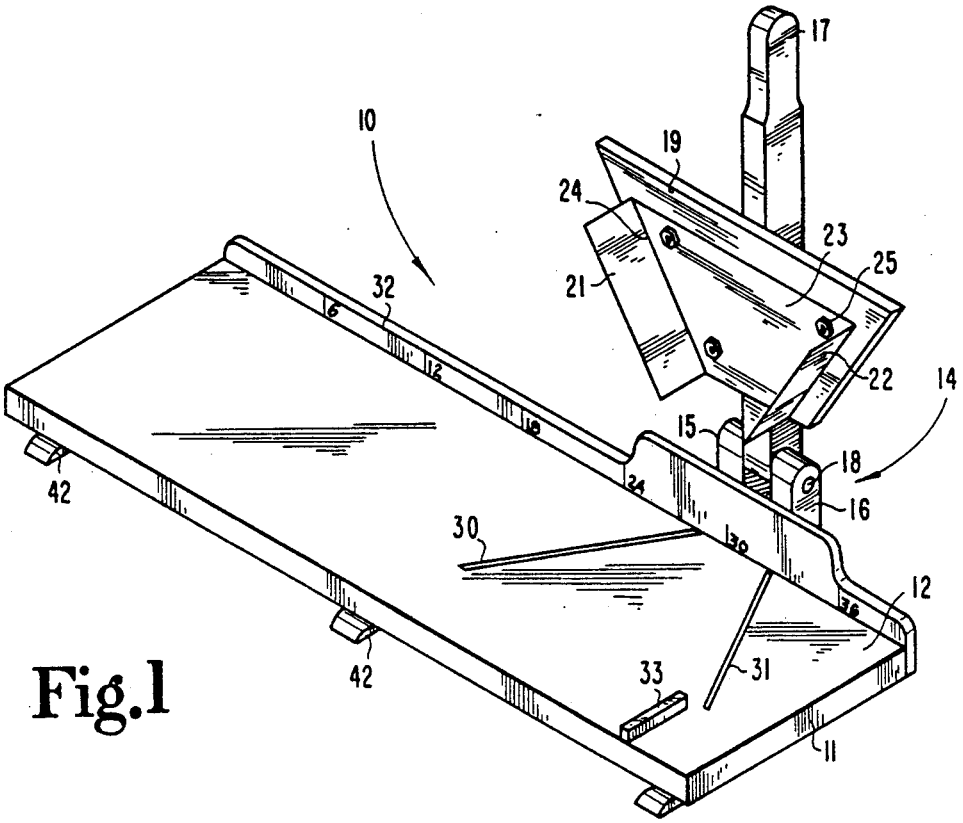
FIG. 1 is a perspective view showing a shingle cutting apparatus constructed in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a relatively simple, accurate, hand-operated cutting apparatus for shingles. The design affords a portable apparatus which is durable in construction. The apparatus may be easily and readily operated by its user to cut shingles, particularly for ridge caps, and can also be used to cut "partial shingles" used at the beginning and end of courses of shingles.

Referring in particular to the drawings, there is shown a shingle cutting apparatus 10 constructed in accordance with the present invention. Apparatus 10 includes a base 11 including a flat, shingle-receiving surface 12. A shingle 13 (FIG. 4) is positioned upon the surface 12 for desired cutting.

Figure 3:
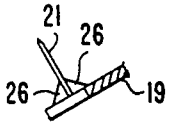
FIG. 3 is a partial, edge view of the blade and blade support mounted on the lever arm, taken along the line 3—3 in FIG. 2 and looking in the direction of the arrows.
Figure 2:
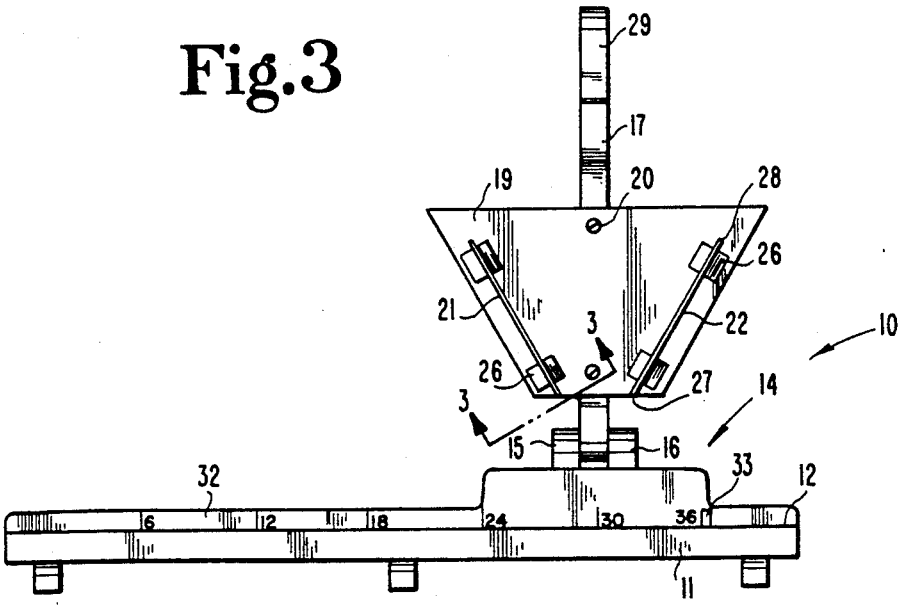
FIG. 2 is a front, elevational view of the shingle cutting apparatus of FIG. 1, showing the lever arm in the up position.
Figure 6:
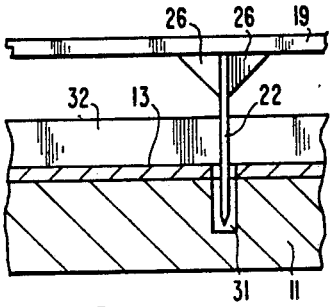
FIG. 6 is a partial, end view showing the receipt of a cutting blade within an associated cutting groove.

A yoke 14 is comprised of yoke arms 15 and 16 which define aligned apertures. A lever arm 17 includes an aperture in alignment with the apertures of the yoke arms 15 and 16 and a shaft 18 is received therethrough to mount the lever arm 17 in pivotal relationship to the yoke arms 15 and 16. A blade support 19 is attached to the lever arm 17 by suitable means, such as screws 20. A pair of blades 21 and 22 are secured to the blade support 19 in suitable fashion. Two versions for mounting of the blades 21 and 22 are shown in the drawings. In FIG. 1, the blades 21 and 22 are shown as integral members of a metal sheet 23, and are formed by folding along lines, such as 24. This integral unit is then secured, such as by bolts 25, to the blade support 19. In the alternative, separate blades 21 and 22 are shown in FIG. 2 as being mounted to the blade support 19 by means of support blocks 26 which are in turn secured to the blade support 19. The support blocks 26 provide means for attaching the blades 21 and 22 to the blade support 19, such as by a press fit, and also provide lateral support as is apparent in FIGS. 3 and 6. For either embodiment, the blades 21 and 22 are removably attached to the blade support 19 to facilitate changing the blades or for other purposes as subsequently described.

The blades 21 and 22 are positioned with cutting edges facing away from the blade support. The blades are positioned in diverging relationship to one another, each having a first end, such as 27, relatively adjacent the pivoted end of the lever arm 17, and a second end, such as 28, relatively closer to the handle portion 29 of the lever arm. The first ends are positioned closer to one another than are the second ends, and the blades consequently diverge in the direction away from the pivoted end of the lever arm.

Figure 4:
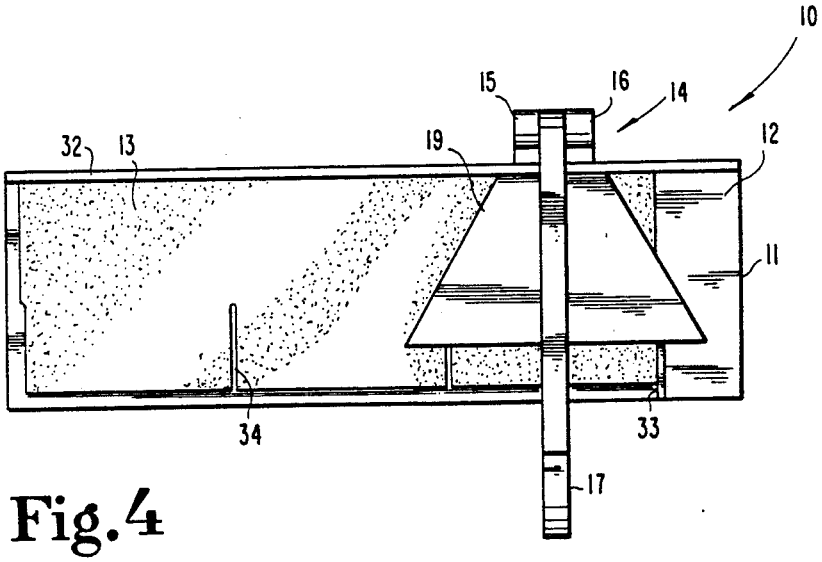
FIG. 4 is a top plan view of the apparatus of FIG. 1 showing the lever arm in the down position.

Base 11 includes a pair of grooves 30 and 31 positioned to receive the cutting edges of blades 21 and 22. Lever arm 17 has a first position in which it is pivoted upwardly, away from the shingle-receiving surface 12, as shown for example in FIGS. 1 and 2. Lever arm 17 has a second position in which it is pivoted adjacent to the shingle-receiving surface, as shown in FIG. 4. In the latter position, the cutting edges of blades 21 and 22 are received within portions of the grooves 30 and 31.

A back stop 32 extends along the back edge of base 11, and serves as a stop or guide for placement of shingle 13 onto surface 12. Back stop 32 is provided with ruled measurements, as shown in FIG. 2, to assist in desired positioning of the shingle relative the cutting blade 39. End stop 33 is mountable to base 11 also to facilitate proper positioning of a shingle on the surface. End stop 33 is desirably located in alignment with a convenient position on the ruled portion of back stop 32, such as an alignment with the 36" position as shown in FIG. 2. In addition, it is desirable to have end stop 33 removable in order to permit desired cutting of partial shingles. End stop 33 may therefore be mounted, for example, by sliding within a groove defined by base 11.

Figure 7:
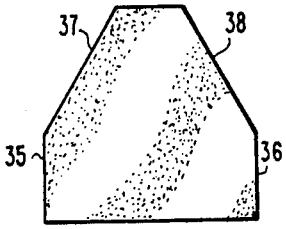
FIG. 7 is a top, plan view of a ridge cap shingle produced by the present invention.
Figure 5:
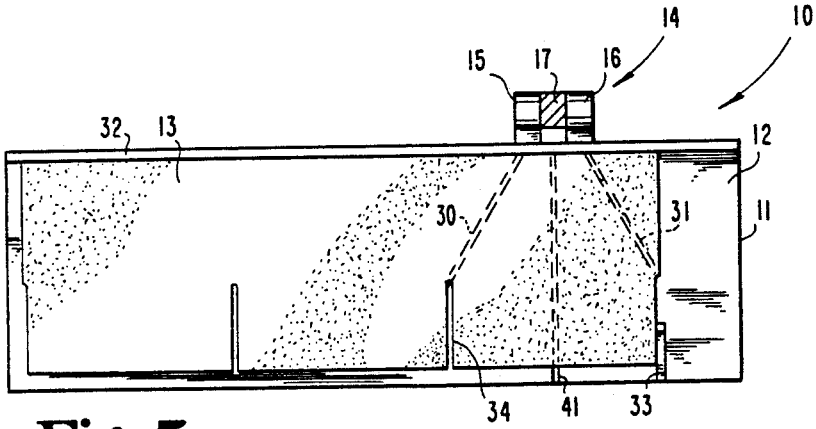
FIG. 5 is a partial, top plan view of the shingle cutting apparatus without the lever arm and the supported blades, showing the positioning of a shingle on the apparatus and relative the cutting grooves.

The operation of the shingle cutting apparatus 10 is shown particularly in FIGS. 4 and 5. When the lever arm 17 is forced downwardly against a shingle 13 received on the base 11, the shingle is cut by the cutting blades. Shingles conventionally are 3 feet in length, with a pair of evenly spaced grooves 34, and extending partially along the width dimension of the shingle. Cutting blades 21 and 22 are positioned such that proper placement of the shingle relative the cutting blades will result in a pair of cuts which yield a six-sided "ridge cap" shingle part, as shown in FIG. 7. The parallel side edges 35 and 36 correspond with either an end of the original shingle 13, or a side of one of the original grooves 34. As shown in FIG. 5, a standard shingle includes a pair of rain grooves 34, and also has recessed ends which will form similar rain grooves when two shingles are placed end to end. As used herein, the term "rain groove" includes both the internal grooves 34 and the edge recesses which form rain grooves with adjacent shingles. The shingle 13, or a angled edges 37 and 38 are produced by the blades 21 and 22, respectively. A series of such ridge cap shingles are typically used along the ridge line of a roof. The present invention provides accurate, uniform ridge cap shingles, and avoids the need to separately hand cut each of these parts.

The desired cutting of a shingle may be achieved by placing the shingle against the back stop 32 and end stop 33. The grooves 30 and 31 extend from the back stop 32 at angles corresponding with the divergence of the blades 21 and 22. Movement of the lever arm downwardly against a shingle therefore results in the blades, such as 22 (FIG. 6), cutting through the shingle 13 and being received within the corresponding groove, such as 31.

Figure 8:
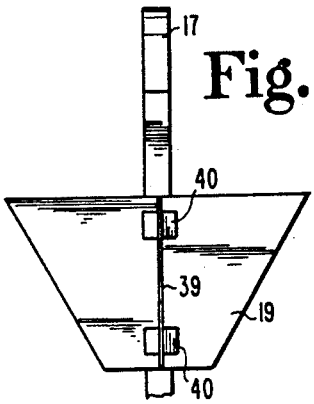
FIG. 8 is a plan view of the blade support, showing an alternate configuration in which the pair of diverging blades have been replaced by a single, perpendicular blade.

It is also desirable at times to be able to cut a shingle into smaller, rectangular portions. These partial shingles are frequently used at the beginning or end of a course of shingles. A cut perpendicular to the lengthwise dimension of the shingle is then desired. The shingle cutting apparatus 10 therefore preferably may be modified to enable this type of cutting. For this purpose, cutting blades 21 and 22 are removed, and a single, perpendicular blade 39 (FIG. 8) is attached. Blade 39 may be attached in a variety of ways, for example, by use of support blocks 40 attached to the blade support 19. For this purpose, a third groove 41 (FIG. 5) is provided. Blade 39 and groove 41 are positioned in corresponding manner and in combination with the ruled back stop 32 may be used to cut off partial shingles of various widths.

The shingle cutting apparatus thus provided is useful for preparing a variety of desired partial shingles. The unit is compact, portable and readily operated, and will endure rugged service. Various modifications to the design for particular applications may be employed. As shown, the apparatus is designed as a portable unit, and therefore may be provided with legs 42 to support the base in a convenient manner. While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for cutting shingles having a first longitudinal edge and a second longitudinal edge, the first longitudinal edge being continuous, the shingle further including spaced rain grooves extending inwardly from the second longitudinal edge, said apparatus being for cutting shingles into a six-sided shape for use in a ridge cap, said apparatus comprising:

a base having a flat, shingle-receiving surface, said base including a back stop for placement thereagainst of the continuous first longitudinal edge of a shingle to align the shingle in position for cutting;

a lever arm having a first end and a second end, the second end having a handle portion;

pivot means for pivotally mounting the first end of said lever arm to said base, said lever arm being movable between a first position adjacent the single-receiving surface;

a blade support attached to said lever arm;

a pair of blades secured to said blade support and having cutting edges facing away from said blade support, said blades being positioned in diverging relationship to one another, each blade having a first end and a second end, the first ends being positioned closer to one another than the second ends, said blades diverging in the direction away from the first end of said lever arm, the second ends of said blades being spaced apart the same distance as the spacing between adjacent rain grooves of a shingle; and alignment means for aligning a shingle on said base to have said blades contact the shingle with the second ends adjacent the spaced rain grooves of the shingle and with the first ends extending adjacent the continuous longitudinal edge of the shingle, said base including a pair of grooves positioned to receive the cutting edges of said blades when said lever arm is in the second position adjacent the shingle-receiving surface of said base, said lever arm having a first position displaced from the shingle-receiving surface to permit placement of a shingle on said surface, said lever arm having a second position with the cutting blades extending into the grooves, whereby a shingle placed on the shingle-receiving surface of said base is cut by said blades by movement of said lever arm from the first position to the second position.

2. The apparatus of claim 1 in which said pivot means includes a yoke secured to said base including a pair of yoke arms defining aligned apertures, said lever arm including an aperture aligned with the apertures of the yoke arms, said pivot means further including a shaft received within the aligned apertures of the yoke arms and said lever arm.

3. The apparatus of claim 1 in which said base includes a rule positioned for determining alignment of a shingle relative the shingle-receiving surface and said cutting blades.

4. The apparatus of claim 1 in which said cutting blades are removably attached to said blade support and further including means for removably attaching said cutting blades to said blade support.

* * * * *

UNITED STATES PATENT AND TRADEMARK OFFICE

CERTIFICATE OF CORRECTION

PATENT NO. : 5,052,256

DATED : October 1, 1991

INVENTOR(S) : N. Richard Morrissey

It is certified that error appears in the above-identified patent and that said Letters Patent is hereby corrected as shown below:

In Column 3, line 63 please change "The shingle 13, or a angled" to --The angled edges--.

In Column 4, line 57 please insert after the word "position" and before the word "adjacent" --displaced from the shingle-receiving surface and a second position--.

In Column 4, line 57 please change the words "the single-receiving" to --the shingle-receiving--.

Signed and Sealed this

Thirteenth Day of April, 1993

*Attest:*

STEPHEN G. KUNIN

*Attesting Officer*

*Acting Commissioner of Patents and Trademarks*